US007182479B1

(12) United States Patent
Flood et al.

(10) Patent No.: US 7,182,479 B1
(45) Date of Patent: Feb. 27, 2007

(54) ELECTRONIC FLARE

(75) Inventors: John F. Flood, Plantation, FL (US); Lester A. Subrattee, Boynton Beach, FL (US)

(73) Assignee: ACR Electronics, Inc., Fort Lauderdale, FL (US)

( * ) Notice: Subject to any disclaimer, the term of this patent is extended or adjusted under 35 U.S.C. 154(b) by 20 days.

(21) Appl. No.: 10/905,411

(22) Filed: Jan. 3, 2005

Related U.S. Application Data

(60) Provisional application No. 60/534,574, filed on Jan. 6, 2004.

(51) Int. Cl.
*F21V 15/04* (2006.01)

(52) U.S. Cl. ..... 362/194; 362/157; 362/184; 362/187

(58) Field of Classification Search ..... 362/157, 362/194, 184, 187; 340/471–473
See application file for complete search history.

(56) References Cited

U.S. PATENT DOCUMENTS 4,345,305 A 8/1982 Kolm
4,763,126 A * 8/1988 Jawetz ..... 340/985
5,228,770 A * 7/1993 Brunson ..... 362/194
5,319,365 A 6/1994 Hillinger
5,521,595 A 5/1996 Totten et al.
5,909,952 A * 6/1999 Guthrie et al. ..... 362/205
6,549,121 B2 4/2003 Povey et al.

* cited by examiner

*Primary Examiner*—Sandra O'Shea
*Assistant Examiner*—James W Cranson, Jr.
(74) *Attorney, Agent, or Firm*—Malin, Haley & DiMaggio, P.A.

(57) ABSTRACT

A portable, hand-held, electrically powered, high intensity directed light beam generating device for use as a replacement for a pyrotechnic flare for search and rescue, especially in a marine environment. The light intensity is generated by a xenon strobe flash tube in a covered, mirror reflective housing that allows for a directional beam of light of less than 6 steradians. The limited radiation light direction provides a safe optical solution for the user to prevent eye damage while increasing the beam intensity and range. The light and illumination section surrounding the strobe flash tube includes thermally conductive paths for the heat generated by the flash tube to be transmitted to the outside of the housing.

13 Claims, 8 Drawing Sheets

ELECTRONIC FLARE

FIELD OF THE INVENTION

This invention relates generally to an emergency flare for use in search and rescue, especially in a marine environment, and particularly to an electric flare that can replace a conventional pyrotechnic flare.

DESCRIPTION OF RELATED ART

The use of hand-held flares made from pyrotechnic material such as a phosphorus burnable material is quite well known. In fact such conventional flares are required on marine vessels in the United States by the U.S. Coast Guard. The great drawback to phosphorus flares is their inherent hazardous nature because of the burning material. Storage of such flares aboard a vessel is always dangerous because of the possibility of accidental ignition, especially in the presence of other hazardous materials aboard ship such as gasoline and fuel oil.

The difficulty in replacing the conventional flare is to find a viable replacement that can provide sufficient light intensity for emergency situations. U.S. Pat. No. 6,549,121 issued to Povey, et al. on Apr. 15, 2003 describes an illuminated emergency signaling device. This device is not capable of high-intensity light transmission and would not be suitable as an emergency electric flare. U.S. Pat. No. 4,345,305 issued Aug. 17, 1982 to Kolm shows a portable electronic safety flare system. The main problem with this device is that it does not produce a very high strobe light intensity required to compare illumination intensity between a pyrotechnic flare and the strobe light shown in this patent. The light illumination direction in U.S. Pat. No. 4,345,305 is oriented 360 degrees around the top of the housing. There is no safety feature to hide high-intensity light from the eyes of a user since the light transmits 360 degrees. Also there are no optical features that could amplify and intensify the amount of light energy concentrated in a specific area. The same problems exist in the lights described in U.S. Pat. No. 5,521,595 issued to Totten, et al. on May 28, 1996 and U.S. Pat. No. 5,319,365 issued to Hillinger on Jun. 7, 1994. The true value of a pyrotechnic flare is the intense amount light transmitted from the device for an extended period of time. None of the prior art references show a comparable electronic or electrically activated light source of high-intensity that can sustain the intensity of a pyrotechnic flare.

Hand-held phosphorus flares are inherently dangerous once ignited because of the high torching temperatures even though phosphorus has a tremendous ability for generating an intense light source that enables search and rescue parties to find people in distress, especially in emergency situations at sea.

Several attempts have been made to get rid of phosphorus flares that burn hazardous materials especially in a marine environment. The present invention overcomes the problems shown in the prior art.

SUMMARY OF THE INVENTION

A portable, hand-held, high-intensity electrically-powered, directed light beam generating device for use as a replacement for a pyrotechnic flare for search and rescue, especially in a marine environment.

The light intensity generated by the present invention is greater than 500 candela. The light is generated by the output from a pulsating xenon strobe flash tube encased partially in a light reflective internal housing having a radiating solid angle of less than 6 steradians. Limiting the direction of light provides a safe optical solution for the user to prevent eye damage while increasing the pulsating strobe light beam intensity and range.

The strobe light housing includes a thermally conductive path between the flash tube and the electrodes of the flash tube for cooling the flash tube due to the intense heat generated. At least one thermal conductor must be electrically insulated. The unit is powered by two high-powered batteries, preferably lithium.

The flash tube timing and control of the pulsating strobe is electronically controlled by electrical circuitry that may use a microprocessor.

A smoke signal generator using conventional technology could be also added to the housing.

A second light (LED) is provided in the preferred embodiment for use as a search and rescue guide light for helicopter crews or for illumination for the user.

The marine application includes a waterproof housing employing an exterior magnetic switch for activation of the strobe light without compromising the housing structure.

It is an object of this invention to replace a pyrotechnic flare used in search and rescue operations with a high-intensity portable light that acts like an electronic or electric flare.

It is another object of this invention to provide a safe signal flare that eliminates the use of pyrotechnic flares especially in marine environment.

And yet still another object of this invention is to provide a very high-intensity portable light beam that is safe for the user and effective for search and rescue, especially in a marine environment.

In accordance with these and other objects which will become apparent hereinafter, the instant invention will now be described with particular reference to the accompanying drawings.

ONE EMBODIMENT OF THE INVENTION

Figure 1:
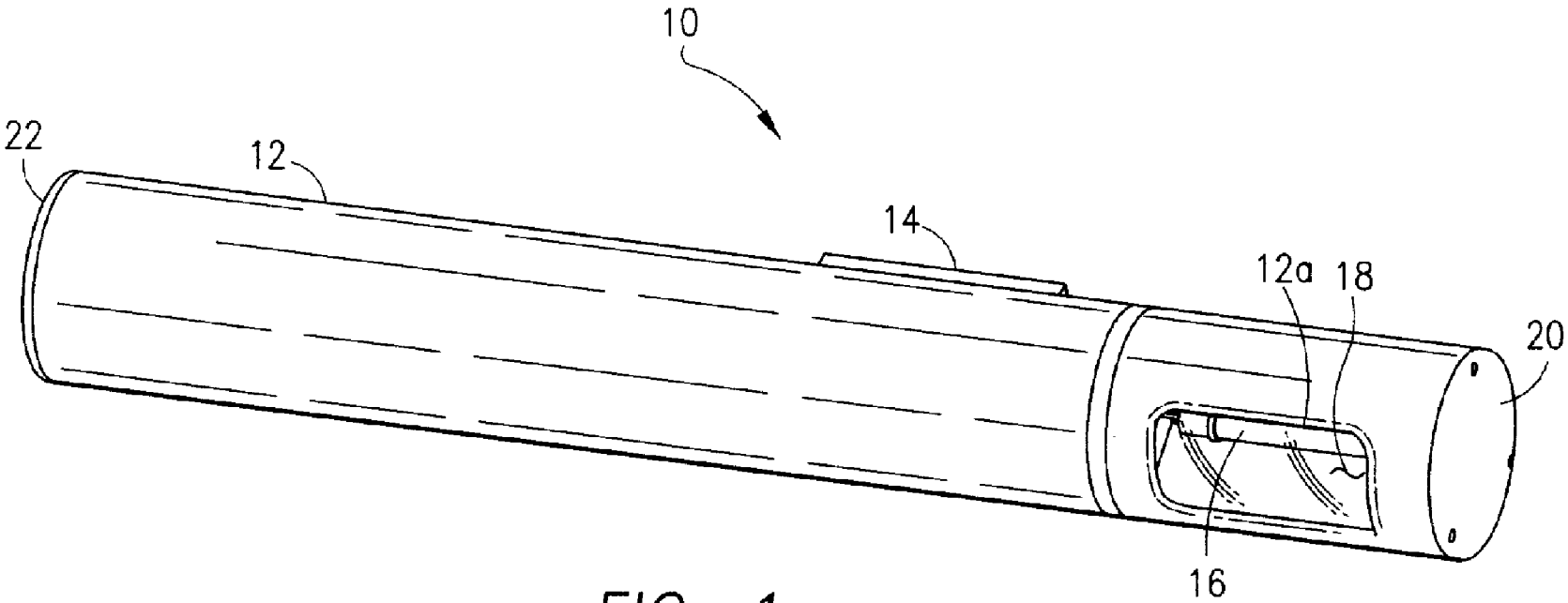
FIG. 1 shows a perspective view of one embodiment of the present invention.

Referring now the drawings and, in particular, FIG. 1, one embodiment of the present invention is shown generally at 10 comprised of a tubular housing 12 having sealed end caps 20 and 22. The housing 12 is a tubular rigid structure constructed of plastic or metal. The electronic flare 10 includes an exterior magnetic switch 14 to turn the strobe light flash tube 16 to the "on" position illuminating the light. The housing 12 has an aperture 12*a* covered by a clear plastic 18 in the upper portion that provides for a directed beam of light that eminates from inside the tubular housing 12 less than 6 steradians of solid angle.

Figure 2:
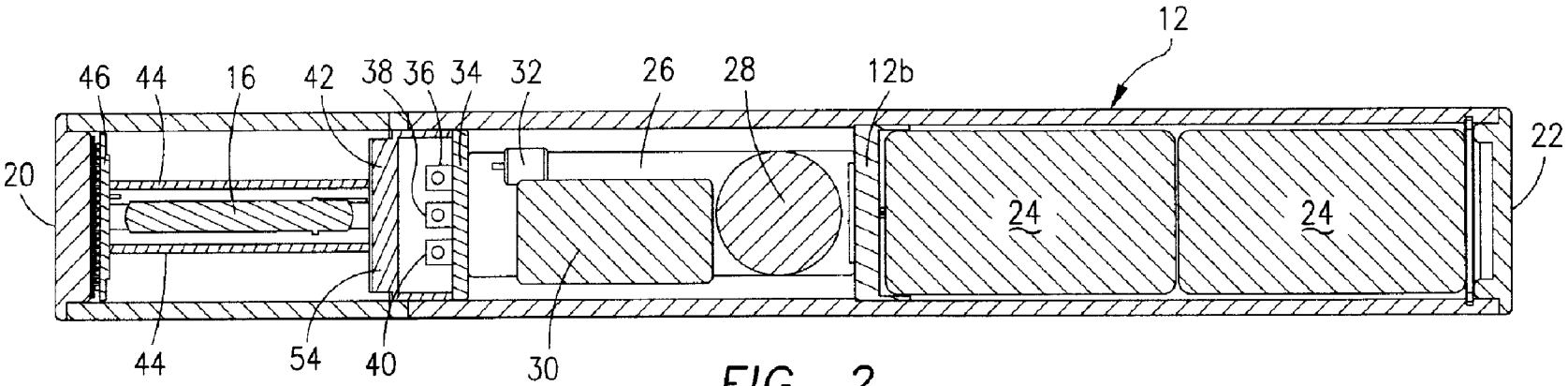
FIG. 2 shows a top plan view of the embodiment of FIG. 1.
Figure 3:
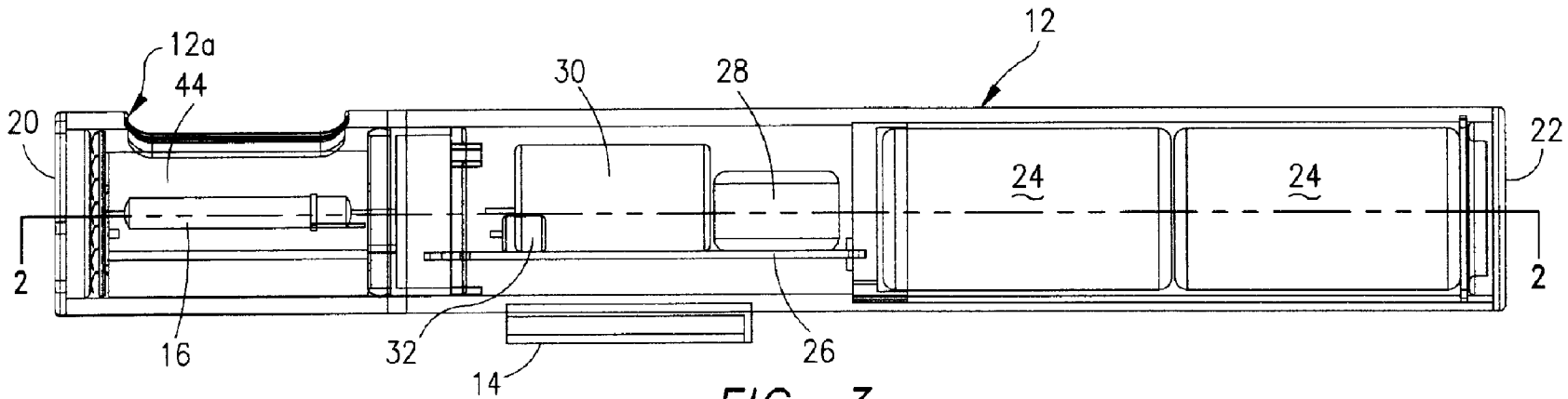
FIG. 3 shows a partially cutaway side elevational view of the embodiment of FIG. 1.

Referring now to FIGS. 2 and 3, the outer housing 12 is shown as a tubular housing divided into three different sections by panel 12*b* and panel 34 which is discussed below. Two batteries 24 are mounted in series in the battery section which is separated from the rest of the device by partition 12*b* which may be an electrical insulative separation. The batteries 24 are conventional high power lithium. Electrical wires attach to the front and rear electrodes of the batteries. The wires connect the electrodes to a circuit board 26. The circuit board is mounted firmly within the midsection of the tubular housing 12.

Mounted on the circuit board is a transformer 28, a capacitor 30 and a trigger 32, all of which are electrically connected to the batteries 24. The circuit board also is magnetically connected to switch 14 (FIG. 3) which is a magnetic on/off switch that is magnetically coupled to an element on the circuit board 26 that allows the entire device to be turned on or off.

The flash tube 16 is encompassed in a mirrored two walled reflector 44 that has a pair of side walls that are disposed at approximately a 45 degree angle forming an enclosure that partially surrounds the xenon flash tube 16. The reflective mirror 44 is mounted at each end to copper thin disks which are used for heat conductive transfer that is described below. The electrodes of the flash tube 16 are connected by wires to electrodes 36 and 40 that are attached to the circuit board 26 that provide the necessary voltage and current to power the tube 16. A third electrode 38 is also attached to a trigger connected to the flash tube to activate and strobe the flash tube 16. The xenon flash tube 16 has a maximum capacity of approximately 30 joules. The transformer 28 can put out approximately 300 volts. The strobe light in the reflective housing as providing this invention is capable of up to excesses of 500 candela and higher. In contrast, the device as described above in the prior art operate more in the one and two candela range. The U.S. Coast Guard minimums for phosphorous pyrotechnic flares is approximately 500 candela which the present invention can equal.

Figure 4:
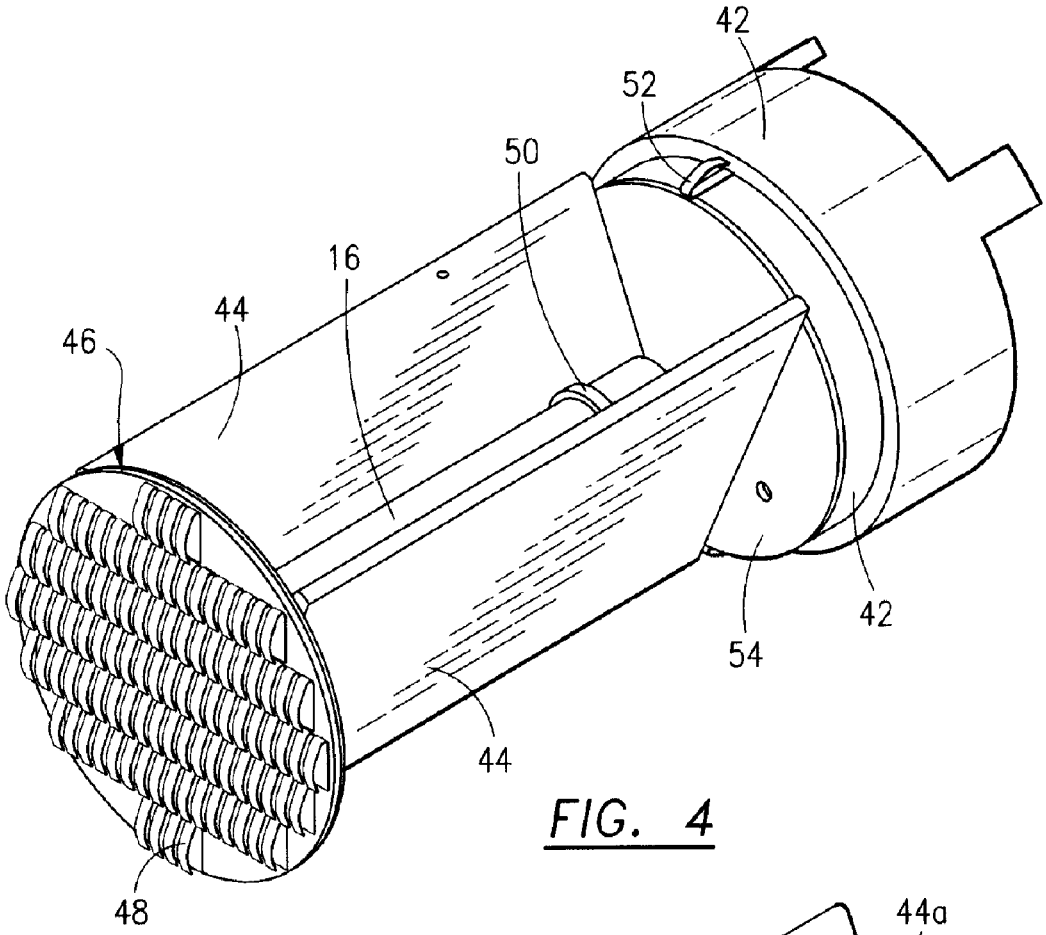
FIG. 4 shows a perspective view of the lighting element portion of the invention that includes the xenon flash tube, a mirrored light reflector and thermal conductors of the embodiment of FIG. 1.

Referring now to FIG. 4, the lighting unit that generates such high intensity light is described along with its ability to conduct heat away from the light source. The flash tube 16 includes a trigger circuit 50 that is electrically connected into the circuit board described above. The longitudinal axis of flash tube 16 is disposed so that the electrodes of the flash tube 16 are connected at one end to disk 54 and at the other end to a laminate 46 (described below) at the opposite end. Compression springs 48 attached to the laminate 46 conduct heat to the end cap 20 shown in FIG. 2 to dissipate heat.

The mirrored reflector 44 includes flat panels that are connected at one end at approximately a 45 degree angle. The xenon strobe flash tube is mounted and encompasses the central portion of the reflecting surfaces 44 that are mirrored. The reflecting mirror 44 is mounted at each end to the laminate disk 46 and copper disk 54 also for heat dissipation. Copper disk 54 transfers heat to the compression springs 52 out to the exterior surface 12 (not shown) in FIG. 4 of the housing.

Figure 5:
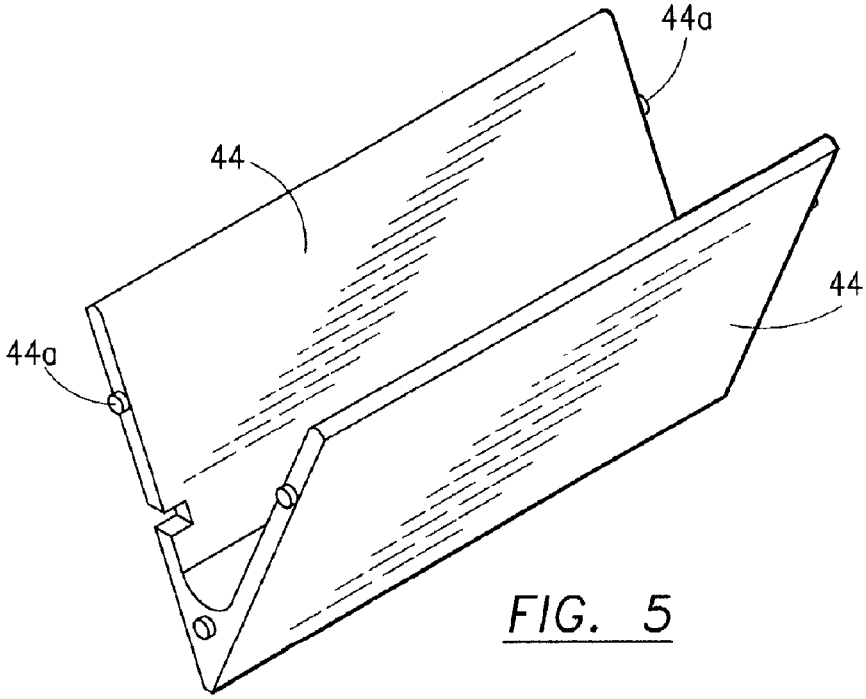
FIG. 5 shows a perspective view of the mirrored reflector used in the embodiment of FIG. 1.

FIG. 5 shows the structure of the reflecting mirror 44 that encompasses the strobe flash tube 16 in the operating position. Note that connecting tabs 44*a* are mounted on each end that are connected to the disks at each end described above.

Figure 6:
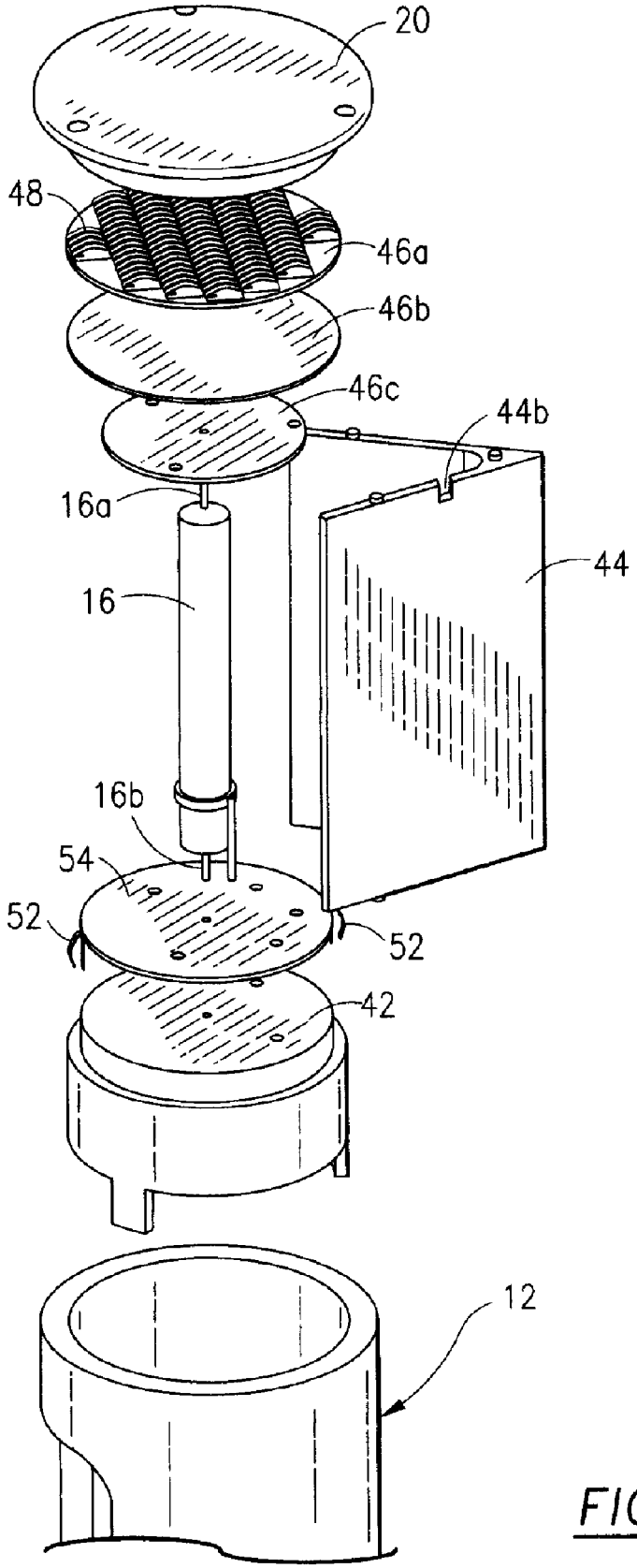
FIG. 6 shows an exploded view of the lighting section of the embodiment of FIG. 1 partially cutaway.

Referring now to FIG. 6, the laminate disk 46 shown in FIG. 4 and its relationship to the operation of flash tube 16 is described. The end cap 20 of the housing contacts compression springs 48 which are attached to a copper disk 46*a* for heat transfer. Laminate disk 46*b* is an electrically insulative thermally conductive material that is sandwiched in between two copper disks 46*a* and 46*c* which provide for heat transfer from the electrode at the end connected to the xenon strobe flash tube 16. Electrode 16*a* is connected by a wire back to the circuit board to power the flash tube 16.

Also in FIG. 6, the flash tube 16 has electrode 16*b* that connects to a copper disk 54 and through mount 42 where it is connected into the circuit board shown in FIG. 2. The purpose of copper disk 54 is to transmit heat from the electrode 16*b* that is generated inside the mirror reflector 44 to the compression springs 52 out to the housing.

Because of the intense heat generated by the electrodes of the strobe flash tube 16 and in the interior the copper disks 46*a* and 46*c* act as heat transmitters. It is essential, however, that the disk 46*b* although being thermally conductive must be electrically insulative to prevent the electrode 16*a* from being shorted out in the operation of the device. The mirrored reflector panels 44 includes a notch 44*b* that allows the wire from electrode 16*a* to be connected into the electrodes shown in FIG. 2.

Figure 7:
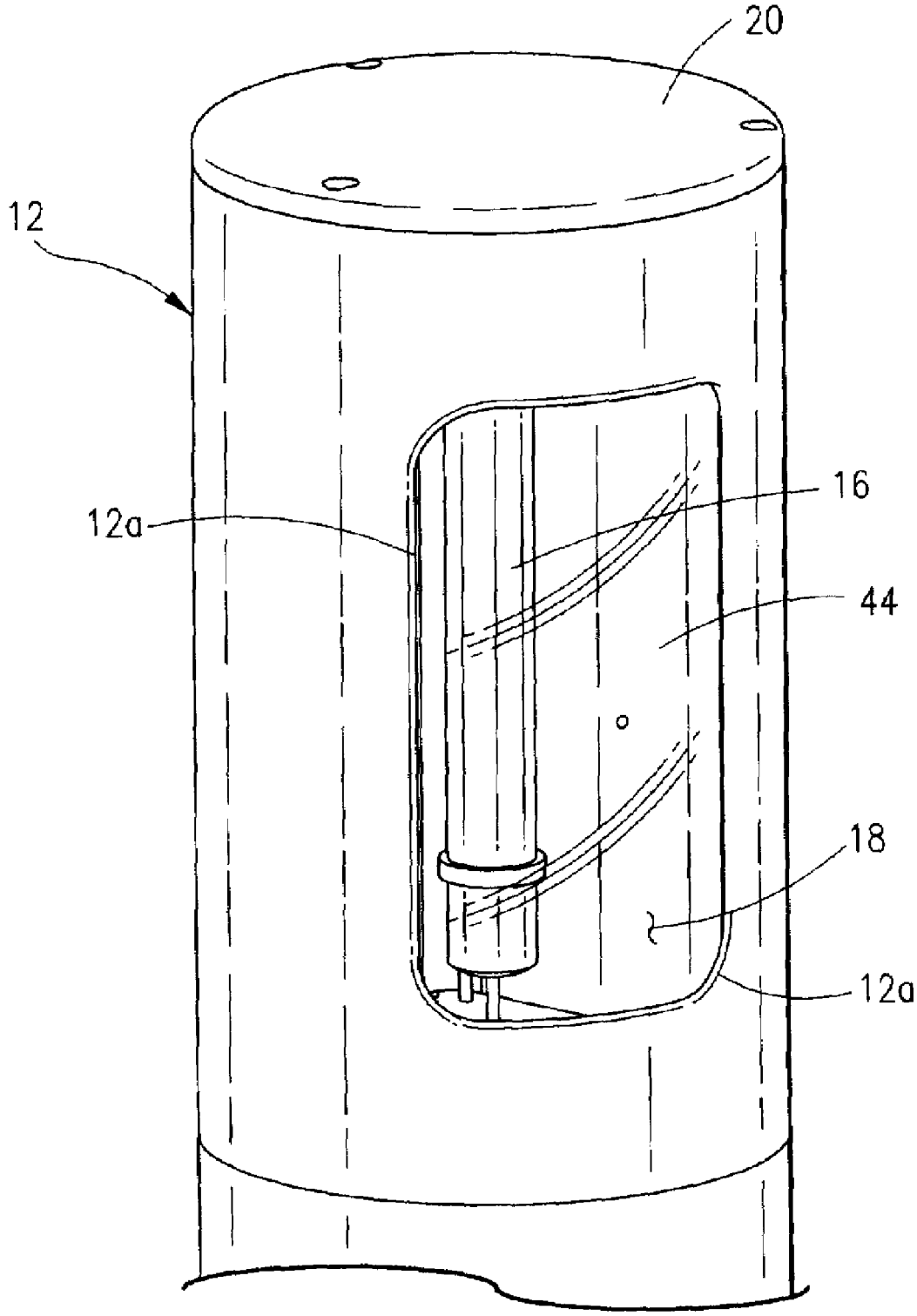
FIG. 7 shows a perspective view of the outside lighting housing section of the embodiment of FIG. 1.

Referring now to FIG. 7, the outside housing 12 near the end cap 20 are shown with the aperture or opening 12*a* which may define approximately 6 steradians circumferentially that allows that amount of intense light to be directed and radiated from the inside of the housing. From top to bottom longitudinally, the housing aperture 12*a* could be approximately two to three inches but also in the realm of less than 6 steradians in terms of size of the opening. The remaining portion of the housing 12 is opaque and no light can escape. The light is generated by the xenon strobe flash tube 16 and is contained and reflected from the mirrored reflector panels 44 which are sized at approximately a 45 degree angle and join the opaque walls and the opening 12*a* to allow light to escape. A transparent or clear plastic cover 18 protects the light flash tube 16 from the outside elements and is sealed joining the opening defined at 12*a*.

To operate the electric flare, referring back to FIG. 1 and FIG. 2, when the on/off switch 14 is turned on, the batteries 24 provide power which is transmitted to the transformer 28 and to the capacitor 30 where the charge is stored. Trigger 32 in conjunction with other circuitry elements on the circuit board 26 shown in FIG. 2 will then provide a pulse of energy through the electrodes to the strobe flash tube 16 illuminating the flash tube. The pulsing sequence can be provided by micro-circuitry on the circuit board including a microprocessor.

In operation, a person desiring to be found can hold the device 10 shown in FIG. 1 by the base and point the directionality of the beam in a desired direction without affecting the eyes of the user. The light intensity above 500 candela approaching 700 candela would be very uncomfortable for the user's eyes and that is why it has a directional beam. Since the device is purely electrical and requires no pyrotechnical chemicals, it is entirely safe for storage aboard ship or in any environment.

Figure 8:
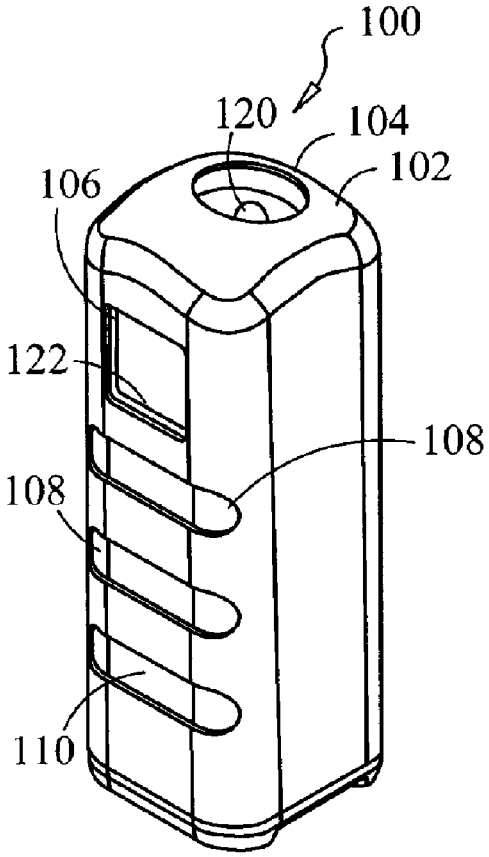
FIG. 8 shows a front perspective view of the preferred embodiment of the invention.

Referring now to FIG. 8, the preferred embodiment of the invention is shown as an electric flare 100 contained in a rigid housing 110 that is covered by a rubber coating 102 that includes cutouts 108 that allow for finger contact for gripping purposes. A plastic transparent, clear window 122 covers the pulsating strobe light reflecting area. The rigid housing aperture 106 defines the light emitting area that would be less than six steradians of emitted light. The rigid housing 110 is opaque to light.

The electric flare 100 also includes a second light, LED 120, mounted inside the top of rigid housing aperture 104. The purpose of light 120 is to provide a steady low intensity light beam to act as a guide for a helicopter crew to bring a helicopter close, once the user of the electronic flare has been found. The use of the electric flare pulsating strobe light because of its intensity could, in many circumstances, destroy the night vision or even the day vision of a search and rescue helicopter pilot and crew. The LED light 120 can also be used for illumination, much like a flashlight, in the survival circumstances.

Figure 9:
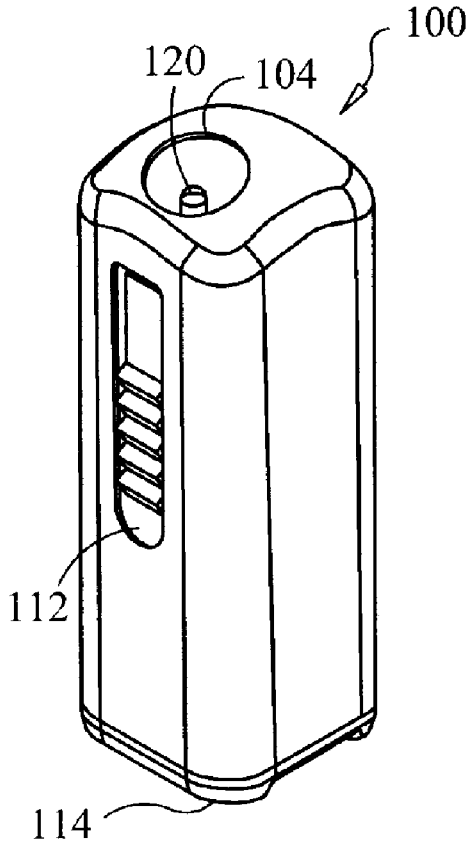
FIG. 9 shows a rear perspective view of the device shown in FIG. 8.

Referring now to FIG. 9, the backside of housing 110 is shown that includes a magnetic reed switch 112 that is used to turn on either the xenon strobe light or the light 120. Note that both the xenon strobe light and the light 120 cannot both be turned on at the same time. The switch 112 is manually activated by pulsing the switch upward and downward. A magnet in the switch activates the magnetic reed switch connected to the interior electrical circuit to both lights.

Figure 10:
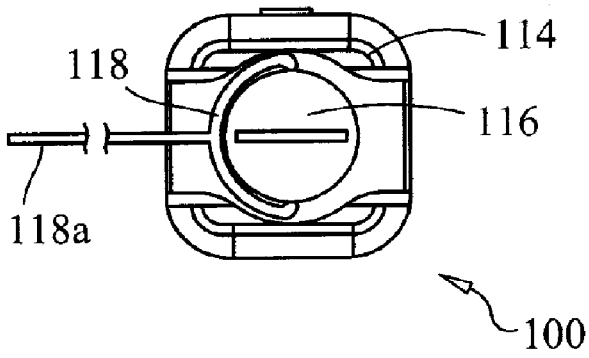
FIG. 10 shows a bottom plan view of the device shown in FIG. 8.

Referring now to FIG. 10, a removable, waterproof cap 116 provides access to remove the housing base 114 from the housing 110 for access to the batteries. A C-clip 118, which may include a lanyard 118*a* can be used to attach the electronic flare to the user or to a raft or other survival equipment.

Figure 11:
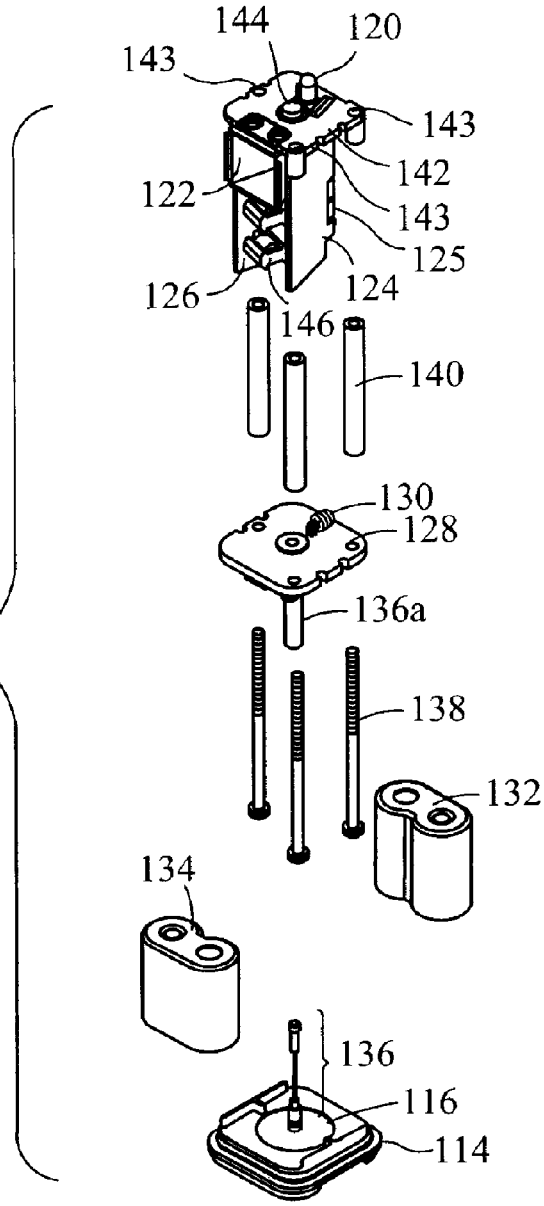
FIG. 11 shows an exploded view of the internal structure in perspective of the preferred embodiment of the invention shown in FIG. 8.

Referring now to FIG. 11, the internal mechanism used for illumination of the pulsating xenon strobe light 144 is shown. A mirrored internal light reflecting housing 122 encompasses a large portion of the vertically mounted strobe light 144 for enhancing the intensity of the strobe light 144 that emanates from the light reflecting surface 122. A pulsating beam of light that is less than 6 steradians in width and height is generated to ensure a light that is as bright as 500 candela which is the same intensity as a phosphorous flare.

The pulsating xenon strobe light 144 is powered by a pair of lithium batteries 132 and 134 that are connected to circuit boards 124 and 126 that contain a microprocessor control circuit, a pair of transformers and a capacitor, all of which are electrically connected to the xenon strobe light 144 mounted inside the reflective housing 122.

The circuit board 128 serves as the upper compartment panel for the batteries 132 and 134 and connects to the end housing base 114 through connector 136 for firmly attaching the end panel 114 to the entire housing in a waterproof fashion through the threaded connector on circuit board 128, all of which connects into an extended fastener 136*a*. Three threaded bolts 138 pass through circuit board 128 and spacers and separators 140 and 143 are threadably connected into the top portion of the housing 110.

Two circuit boards 124, 126 and mounting plate 142 are joined together and are connected to the illumination reflective housing 122 which is tapered from side to side with two parallel top and bottom panels that are all internally light reflective. The housing 122 has internal mirrored surfaces to transmit and reflect light efficiently from the pulsating xenon strobe light 144. Circuit board 124 also includes the LED 120 as electrically connected through the magnetic switch 112 described below to act as the guide light. The upper end of the strobe light 144 is shown.

Circuit board 126 includes a capacitor and a pair of transformers 146, all of which are electrically connected to the xenon strobe light 144 through the magnetic switch described below. Circuit board 124 includes a reed switch 125 that is disposed adjacent the magnetic switch 112 and allows for turning on (and off) either the strobe light 144 or LED 120.

The heat transfer in the device is accomplished by transfer from fasteners 143 through bolts 138. Also, there is copper on the circuit boards and the metal top reflector which helps divert the heat generated by the xenon strobe light. Additionally, heat is spread by convection currents generated within the device.

The preferred embodiment shown in FIGS. 8 through 13 is extremely compact and includes an LED 130 that indicates low battery, electronic life and battery life reset.

Figure 12:
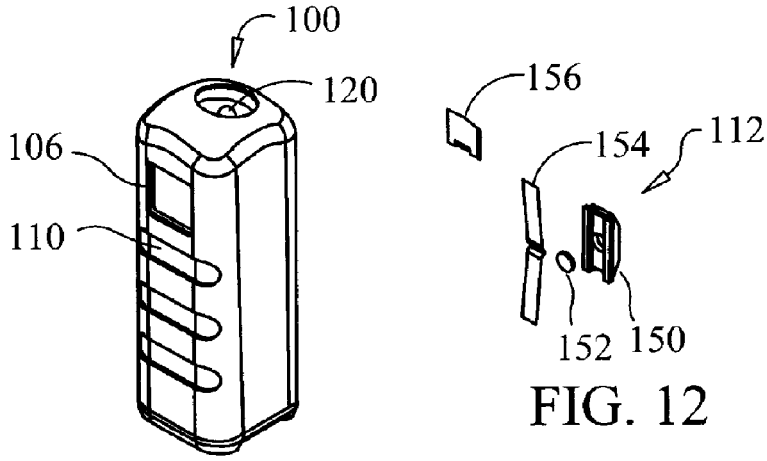
FIG. 12 shows a perspective view of the magnetic switch partially exploded of the preferred embodiment of the invention.

Referring now to FIG. 12, an exploded view of the magnetic switch 112 is shown including a movable on/off button 150 that includes a magnet 152 mounted therein and a metal clip 154 that provides spring tension for movement of the button 150, all of which is mounted to the housing 110 through fastener 156. The magnetic switch 112 operates reciprocally up and down, back and forth, on/off for turning on either the strobe light 144 or which when moved back and forth will then activate the LED 120 turning off the strobe light. The magnet actuates the reed switch 125 mounted on circuit board 124. There is also an indicating light 130 which is a LED mounted just below magnetic switch 112 that shows that indicates low battery, electronic life and battery life reset.

Figure 13:
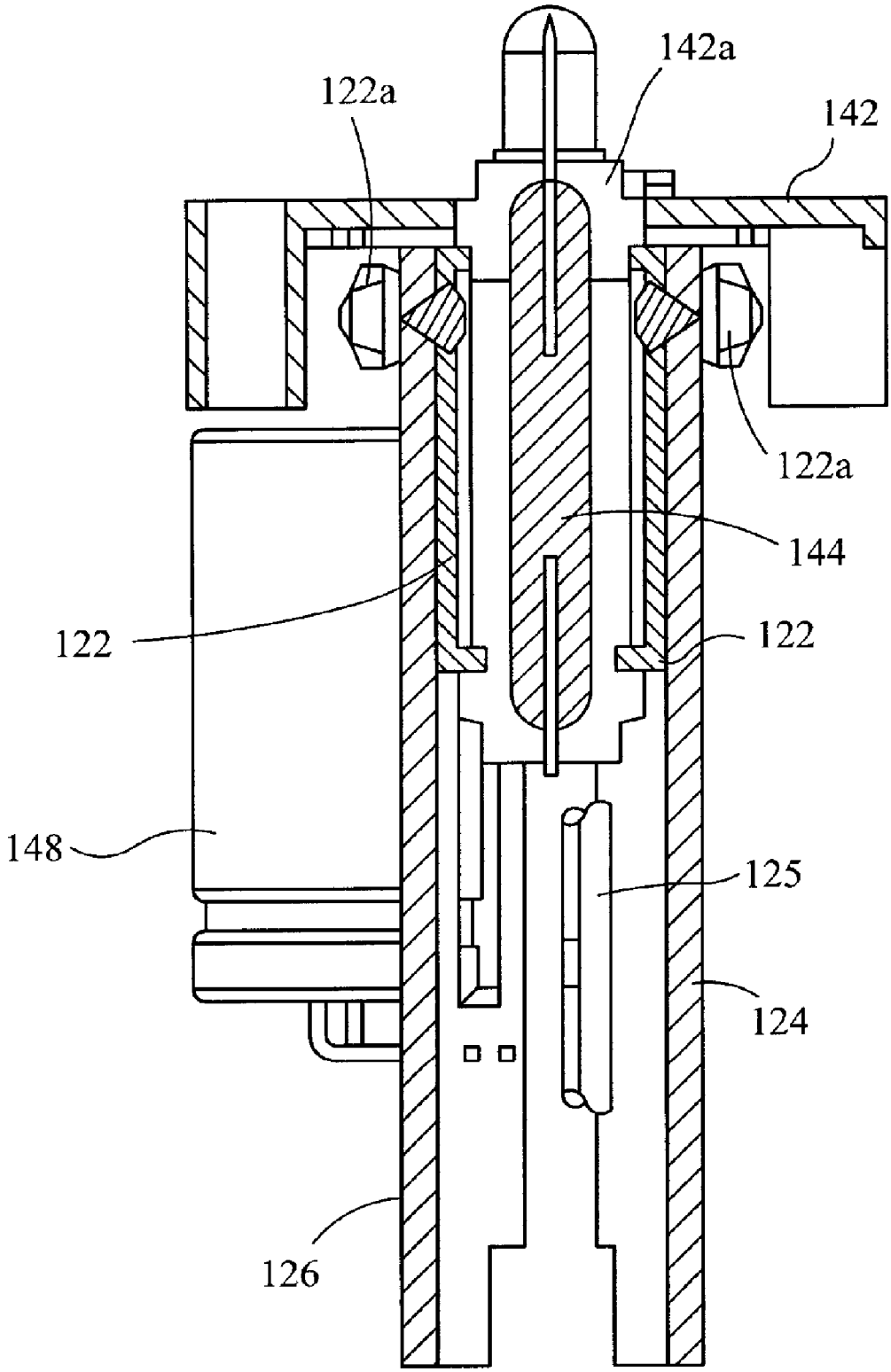
FIG. 13 shows a front elevational view in cross section of the internal mechanism of the preferred embodiment shown in FIG. 8.

Referring now to FIG. 13, the strobe light 144 is shown in its relationship to the reflective surfaces that are mirrored housing panels 122 on each side of the xenon strobe light 144. Mounting plate 142 includes a support 142*a* that receives the upper end of the strobe light 144. Also shown are circuit board 124 and circuit board 126 that includes capacitor 148. The reflective housing 122 is connected to circuit boards 124 and 126 with threaded fasteners 122*a*.

To operate the preferred embodiment, the magnetic switch 112 is moved to turn on power from the batteries through the transformers and capacitor. A microprocessor on circuit board 126 includes a timer circuit to discharge compacitor 148 so that pulses of electricity are sent to the xenon strobe light 144 allowing the strobe light to illuminate producing up to 500 or more candela. In the preferred embodiment, a pulse is sent every three seconds (twenty times per minute). The timing sequence (pulses per minute) can be changed by the microprocessor circuitry. By moving the magnetic switch 12 reciprocally, the guide light 120 can also be activated without the strobe light.

Using the present invention and especially the preferred embodiment, a very small handheld electronic flare that generates immense candela safely without risking eye damage can be conveniently carried by someone in a survival situation.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An electrically powered flare for generating an intense directed light beam comprising:

a xenon strobe lamp;

a mirrored light reflecting housing including a two walled mirrored reflector, having two flat panels disposed at approximately a 45 degree angle mounted adjacent said xenon strobe lamp for directing most of the light output from the strobe lamp;

an opaque housing that includes a clear light directing aperture window for directing most of the light output from the strobe lamp into a small exit angle of less than 6 steradians, said mirrored housing and said xenon strobe lamp mounted within said opaque housing facing said window;

a lithium primary or high rate secondary battery mounted within said housing;

a circuit including an on/off switch for providing electrical power to said xenon strobe light;

a transformer connected to said power circuit for upping the voltage of said battery to provide a high voltage for said xenon strobe light; and a capacitor connected to said circuit for accumulating charge for powering said said xenon strobe light.

2. An electric flare as in claim 1, including:

a magnetic on/off switch coupled to said circuit for turning said xenon strobe light on and off and mounted to said housing exterior.

3. An electric flare as in claim 2, wherein:

said housing is waterproof to prevent water from reaching the inside of said housing.

4. An electric flare as in claim 1, wherein:

said mirrored housing includes two flat mirrored surfaces disposed adjacent said xenon strobe lamp at less than a forty-five degree angle to each other to provide a beam of light of a particular width for enhancing the light intensity of the xenon strobe lamp and a safe non-lighted zone outside the intense beam is created for the user to protect the user's eyes from the light beam.

5. An electronic flare as in claim 1, including:

a LED light mounted inside said housing and including a LED light aperture for providing a guide light in said housing.

6. An electronic flare as in claim 1, including:

said xenon strobe lamp including a flashtube having flashtube leads and a glass envelope; and a thermal path through the flashtube leads and by convection from the flashtube glass envelope to limit the flashtube temperature to a safe level.

7. An electronic flare as in claim 6, wherein:

at least one of the strobe lamp flashtube leads is electrically insulated.

8. An electronic flare as in claim 6, wherein:

said mirrors are connected and supported by a pair of copper disks for heat transfer.

9. An electronic flare as in claim 6, wherein:

said xenon strobe lamp is a long are bulb.

10. An electronic flare as in claim 6, wherein;

said xenon strobe light emitting window is approximately between two to three inches in length longitudinally.

11. An electronic flare as in claim 6, including:

said electronic flare housing is waterproof, and an on/off reed switch connected to said waterproof housing for turning on and off the xenon strobe light.

12. An electronic flare as in claim 11, including:

said reed switch having at least three positions, a first position for turning on said xenon strobe lamp, a second position for turning on said LED and a third position for turning off both the LED and the xenon strobe lamp, said switch preventing both the LED and the xenon strobe lamp from being illuminated at the same time.

13. An electronic flare as in claim 6, wherein:

said xenon strobe lamp when illuminated produces at least five hundred candela.

* * * * *